US010980330B2

(12) United States Patent
Chen

(10) Patent No.: US 10,980,330 B2
(45) Date of Patent: Apr. 20, 2021

(54) ASSEMBLY FOR DISPENSING A FLUID PRODUCT

(71) Applicant: APTAR FRANCE SAS, Le Neubourg (FR)

(72) Inventor: Alexandre Chen, Le Neubourg (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/091,571

(22) PCT Filed: Apr. 4, 2017

(86) PCT No.: PCT/FR2017/050784
§ 371 (c)(1),
(2) Date: Oct. 5, 2018

(87) PCT Pub. No.: WO2017/174918
PCT Pub. Date: Oct. 12, 2017

(65) Prior Publication Data

US 2019/0116960 A1 Apr. 25, 2019

(30) Foreign Application Priority Data

Apr. 8, 2016 (FR) ..... 16 53134

(51) Int. Cl.
*A45D 34/00* (2006.01)
*B05B 11/00* (2006.01)
(Continued)

(52) U.S. Cl.
CPC ..... *A45D 34/00* (2013.01); *B05B 11/0035* (2013.01); *B05B 11/00416* (2018.08);
(Continued)

(58) Field of Classification Search
CPC ..... B05B 11/00416; B05B 11/0035; B05B 11/3032; A45D 34/00; A45D 2200/052; A45D 2200/055; B65D 25/56
See application file for complete search history.

(56) References Cited

U.S. PATENT DOCUMENTS 4,704,088 A * 11/1987 Newman ..... A61O 5/55 433/81
9,569,939 B2 * 2/2017 Heinz ..... G08B 5/00
(Continued)

FOREIGN PATENT DOCUMENTS

GB 1490782 * 11/1977 ..... B05B 11/00
JP 2007-153415 A 6/2007

OTHER PUBLICATIONS

International Search Report for PCT/FR2017/050784, dated Jul. 13, 2017.

(Continued)

*Primary Examiner* — J C Jacyna
(74) *Attorney, Agent, or Firm* — Sughrue Mion, PLLC

(57) ABSTRACT

A fluid dispenser assembly having a fluid reservoir (R), a dispenser member (5), and a dispenser orifice (62). The fluid reservoir (R) includes a piston (42) movable in leaktight sliding contact in a slide cylinder (41) over a maximum stroke between a start position that corresponds to a substantially full state of the reservoir, and an end position that corresponds to a substantially empty state of the reservoir. The dispenser assembly has a detector (35) arranged outside the fluid reservoir (R) and acts remotely to detect a determined physical property that enters into a small detection field that covers an alert position of the piston that is closer to the end position than to the start position. The piston (42) carries the detectable determined physical property and the detector (35) delivers, in response to a detection of the physical property, at least one alert signal perceptible to a user.

16 Claims, 4 Drawing Sheets

(51) Int. Cl.
*B65D 25/56* (2006.01)
*B05C 17/01* (2006.01)

(52) U.S. Cl.
CPC ..... *B05B 11/309* (2013.01); *B05B 11/3032* (2013.01); *B05C 17/0136* (2013.01); *B65D 25/56* (2013.01); *A45D 2200/052* (2013.01); *A45D 2200/055* (2013.01)

(56) References Cited

U.S. PATENT DOCUMENTS

| | | | | |
|---|---|---|---|---|
| 2012/0267390 | A1 | 10/2012 | Jeong et al. | |
| 2012/0267391 | A1 | 10/2012 | Yoo | |
| 2013/0264358 | A1* | 10/2013 | Fallat, II | A45D 34/04 222/136 |
| 2016/0213834 | A1* | 7/2016 | Brady | A61M 5/31573 |
| 2016/0257549 | A1* | 9/2016 | Volftsun | B67D 7/80 |
| 2017/0096322 | A1* | 4/2017 | Volftsun | B67D 1/0007 |

OTHER PUBLICATIONS

International Preliminary Report on Patentability with a Translation of Written Opinion issued from the International Bureau in counterpart International Application No. PCT/FR2017/050784, dated Oct. 9, 2018.

* cited by examiner

ASSEMBLY FOR DISPENSING A FLUID PRODUCT

This Application is a National Stage of International Application No. PCT/FR2017/050784 filed Apr. 4, 2017, claiming priority based on French Patent Application No. 16 53134 filed Apr. 8, 2016.

The present invention relates to a fluid dispenser assembly comprising a fluid reservoir, a dispenser member, and a dispenser orifice, the reservoir including a piston that is movable in leaktight sliding contact in a slide cylinder over a maximum stroke defined between a start position that corresponds to a substantially full state of the reservoir, and an end position that corresponds to a substantially empty state of the reservoir. Thus, the assembly makes it possible to apply a fluid to a target such as the skin. Naturally, an advantageous field of application for the present invention is the field of cosmetics, but it may also be the field of pharmacy.

In the prior art, numerous dispensers of this type already exist, including a reservoir provided with a piston of the follower or pusher type. When the reservoir is empty, the user is informed of this merely by fluid not being delivered after one or more actuations. Optionally, it is possible to make the reservoir out of transparent material, so that the user sees what remains in the reservoir.

Document WO2015/170048 is also known, which describes a dispenser assembly using a reservoir provided with a follower piston.

Documents US 2012/267390, JP 2007/153415, and US 2012/267391 are also known, which describe systems that make it possible to give a visual indication of the position of a follower piston in a slide cylinder. However, those systems are all passive, such that the user must consult the visual indication, but does not receive information.

An object of the present invention is to improve the fluid dispenser assemblies of the prior art by giving the user clear, reliable, and perceptible information about the filling and emptying state of the piston reservoir.

To do this, the present invention proposes a fluid dispenser assembly comprising a fluid reservoir, a dispenser member, and a dispenser orifice, the reservoir including a piston that is movable in leaktight sliding contact in a slide cylinder over a maximum stroke defined between a start position that corresponds to a substantially full state of the reservoir, and an end position that corresponds to a substantially empty state of the reservoir, the dispenser assembly being characterized in that it further comprises detector means for detecting a physical property, the detector means having a detection field that is small relative to the maximum stroke of the piston, the physical-property detector means being arranged outside the fluid reservoir so as to act remotely, through the slide cylinder, to detect a determined physical property that enters into the small detection field that covers an alert position of the piston that is closer to the end position than to the start position, the piston carrying said detectable determined physical property, the detection means delivering, in response to a detection of the physical property, at least one alert signal that is perceptible to a user. Thus, remote-detection technology is used to give clear, reliable, and perceptible information to the user, who, as a result, does not need to verify continuously the filling and emptying state of the reservoir.

Advantageously, the slide cylinder is arranged between the piston and the detector means, the slide cylinder not preventing the detector means from detecting the determined physical property. In other words, the material constituting the cylinder is transparent for the detector means and/or the physical property.

The alert position is reached when the piston has moved through more than 75%, or more than 90%, or even 100%, of its maximum stroke from the start position. However, it is also possible to envisage other additional alert positions, e.g. at half the maximum stroke of the piston, or at one-fourth of its stroke. By way of example, the piston may reach a plurality of successive alert positions as it moves towards the end position, the alert positions being successively detected by the detector means that advantageously deliver a plurality of distinct respective alert signals.

In an advantageous embodiment, the detector means are mounted on an integrated circuit board. In a practical embodiment, the fluid reservoir, the dispenser member, and the dispenser orifice are formed by a dispenser that is removably insertable into a casing forming an applicator surface and integrating the detector means, which detector means are advantageously mounted on an integrated circuit board that extends substantially parallel to a plane that contains the fluid reservoir, the dispenser member, and the dispenser orifice. The dispenser assembly thus presents a configuration that is close or identical to the configuration in document WO 2015/170048.

In an advantageous aspect, the detector means are positioned in contact with the slide cylinder, or in its immediate proximity, so as to reduce the distance between them and the piston.

In an embodiment, the detector means may comprise a magnetic-field sensor, and the piston is provided with a magnet that generates a magnetic field as the detectable determined physical property. The magnet may present a volume that is less than 40 cubic millimeters ($mm^3$), advantageously less than 30 $mm^3$, and still more advantageously less than 20 $mm^3$. The magnet may be annular with an outside diameter that is a little smaller than the maximum outside diameter of the piston, such that the magnet is close to the slide cylinder.

In a variant, the piston is made by injection-molding plastics material filled with magnetized particles.

In another embodiment, the detector means comprise a determined-wavelength sensor, and the piston emits waves having said determined wavelength. By way of example, the determined wavelength may be in the red, and the piston is red at least in part.

In a widespread applicator embodiment, the piston is a follower piston that moves when the fluid in the reservoir is under suction.

The spirit of the invention resides in remotely detecting the passage of the piston that moves in the cylinder of the reservoir, so as to be able to provide visual and/or audible information to the user about the filling and emptying state of the reservoir. The remote detection may use any technology, e.g. induction (detecting a magnetic field or detecting disruption of a magnetic field), optical (color, reflection, refraction, diffraction), the capacitive effect, ultrasound, the Hall effect, the Faraday effect, resistance variation, etc.

The invention is described below in greater detail with reference to the accompanying drawings, which show an embodiment of the invention by way of non-limiting example.

Figure 3:
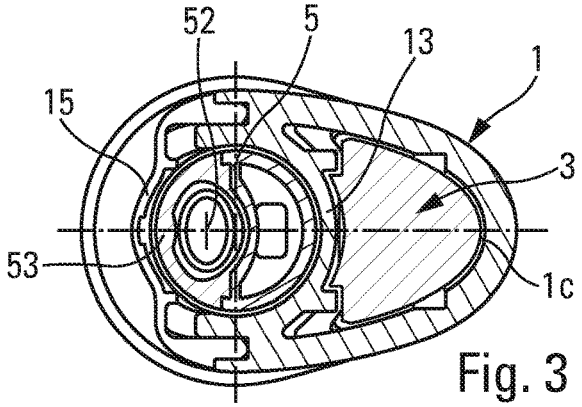
FIG. 3 is a horizontal cross-section view on section line A-A in FIG. 2.

Firstly, the present invention is illustrated with reference to FIGS. 1 to 8, which show a dispenser and applicator assembly similar to the dispenser and applicator assembly in document WO 2015/170048, with the addition of remote detection. The dispenser and applicator assembly presents an elongate or slender shape that may be similar to the shape of a pen. It should also be observed that its cross-section is not constant, since it varies significantly from bottom to top. Specifically, in the proximity of its bottom end, the dispenser and applicator assembly presents a cross-section that is generally round or circular, while at the section line A-A, which is generally situated in the proximity of the top end, the dispenser and applicator assembly presents a cross-section that is egg shaped (FIG. 3). The top face of the assembly forms an applicator surface S that inclines or slopes towards one side.

Figure 4:
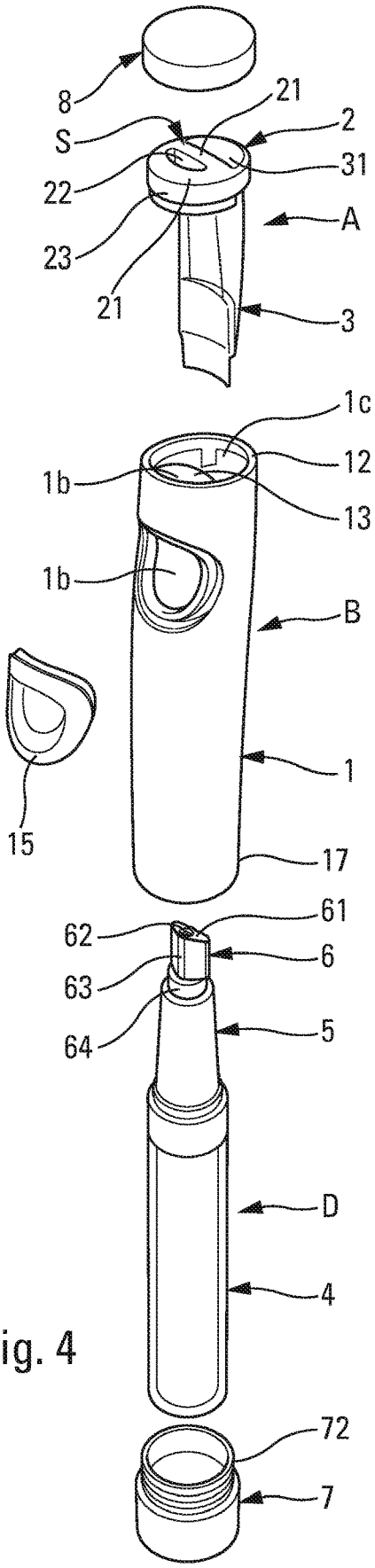
FIG. 4 is an exploded perspective view of the dispenser and applicator assembly in the above figures.
Figure 5:
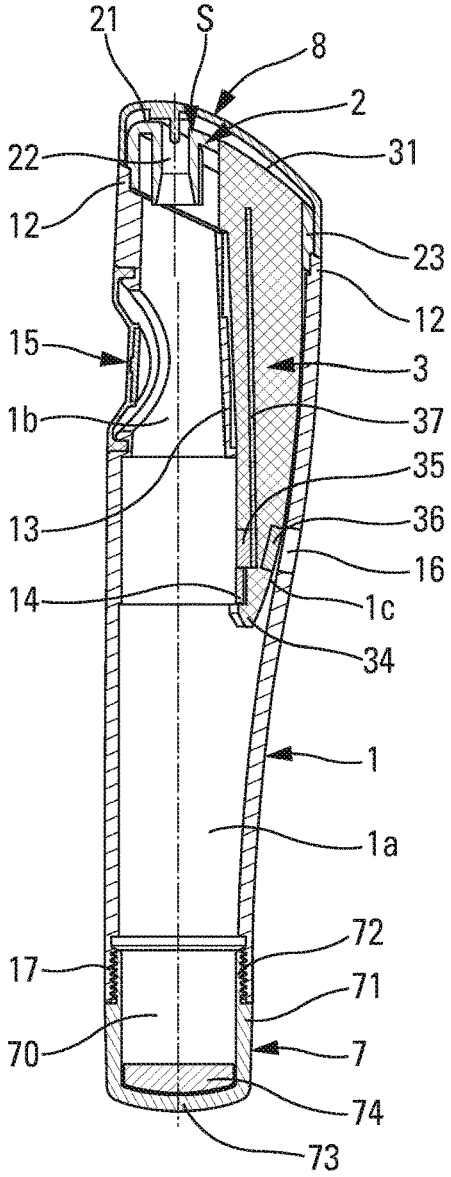
FIG. 5 is a view similar to the view in FIG. 1, in the absence of a fluid dispenser.

With reference to FIG. 4, it is possible to see the various component elements of the dispenser and applicator assembly of the invention. Initially, it should be observed that it comprises three main distinct units, namely a dispenser unit D, a reception unit B, and an applicator unit A. The dispenser unit D, which is a fluid dispenser, is advantageously received in removable manner inside the reception unit B that comprises a single-piece reception body 1 having an inside that is hollow. The applicator unit A is mounted on and in the body 1, advantageously in removable manner. Thus, the two units D and A are preferably received in removable manner on and in the body 1 from the two opposite ends 17 and 12 respectively. This is the general structure of the dispenser and applicator assembly of the invention.

In greater detail, the body 1 of the reception unit B is open at its top and bottom ends 12, 17 so as to be able to receive the units A and D. The inside of the bottom end 17 is advantageously threaded so as to receive a removable end wall 7 by screw-fastening. The removable end wall presents the shape of a small pot with a bottom wall 73 and a cylindrical side wall 71 having a top portion that forms a thread 72 having a pitch that corresponds to the pitch of the bottom end 17 of the body 1. It should be observed that on top of its bottom wall 73, the removable end wall 7 is provided with a piece of elastic material 74 that may be foam or an elastomer. The inside of the removable end wall 7 forms a space 70 that upwardly communicates with the inside of the body 1, which itself defines a reception space 1*a*. Beyond the reception space 1*a*, the inside of the body 1 is divided into two compartments 1*b* and 1*c* by a separating partition 13. The compartment 1*b* extends axially running on from the space 1*a*, while the compartment 1*c* extends laterally, where the body 1 defines its egg shape. The bottom end of the partition 13 forms a snap-fastener edge 14, as described below. Level with the compartment 1*b*, the body 1 is provided with a lateral pusher 15 that is movable transversally relative to the longitudinal axis of the reception body 1. The pusher 15 may be moved purely in translation or it may be deformed elastically. By way of example, it is possible to envisage molding the pusher 15 onto the reception body 1, using an elastomeric material. In a variant, it is also possible to envisage a pusher 15 that moves completely independently of the body 1. It is also possible to envisage not having a pusher 15 but only an opening. It should also be observed that the separator partition 13 extends into the proximity of the top end 12. The reception body 1 may be made merely by injection molding plastics material, or it may even be made of metal.

Figure 1:
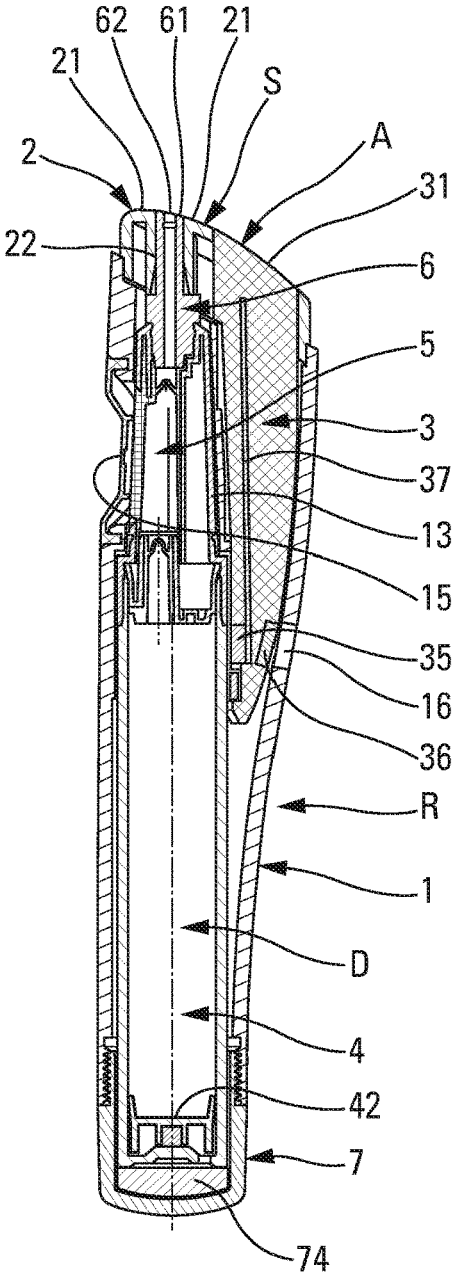
FIG. 1 is a substantially life-size vertical-section view through a fluid dispenser and applicator assembly of the invention.
Figure 2:
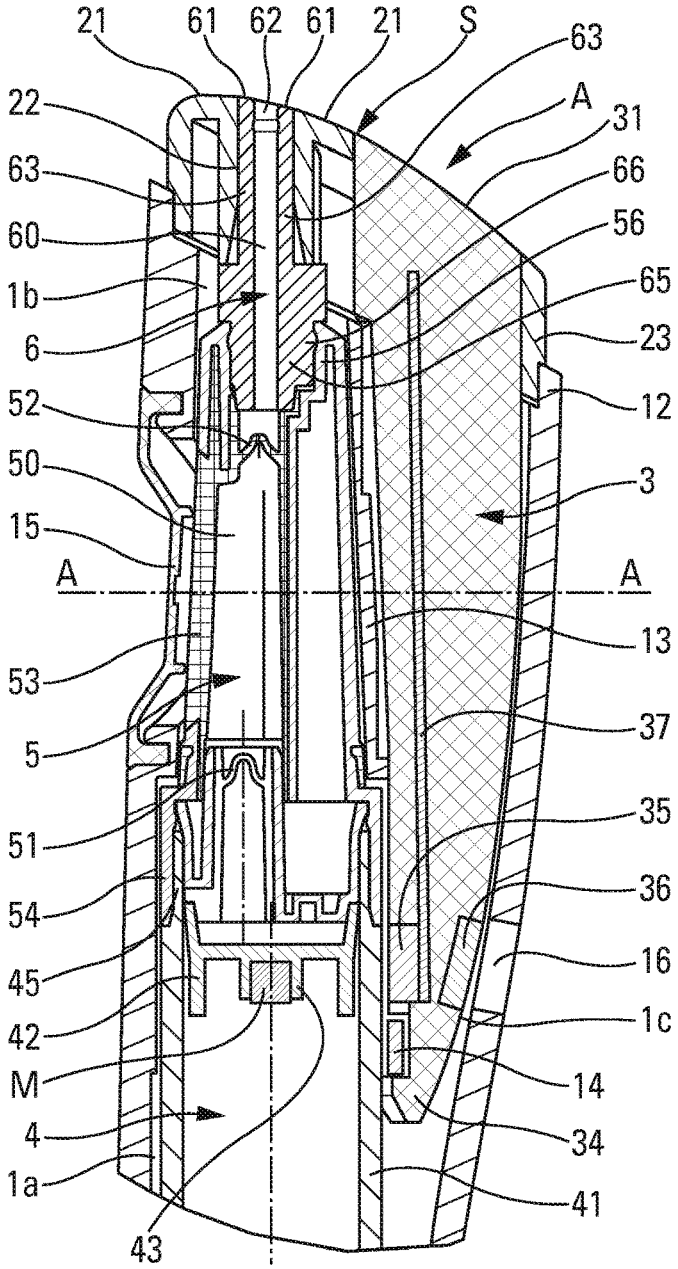
FIG. 2 is a greatly enlarged view of the top portion of FIG. 1.

In this embodiment, the applicator unit A results from combining an applicator head 2 and a wave-generator module 3. As can be seen in FIGS. 1 and 2, the applicator head 2 includes an axial housing 22 that is formed by a cylindrical tube having a cross-section that presents a geometrical shape that is complex, e.g. the shape of a crescent. The housing 22 is upwardly connected to an applicator-surface area 21 that, in this embodiment, is formed with two openings, namely a first opening corresponding to the mouth of the housing 22, and a second opening for the module 3. More precisely, the module 3 includes an applicator-surface section 31 that closes the corresponding opening of the head 2 in such a manner as to complete the applicator-surface area 21 of the head 2 in continuous and smooth manner. In other words, the module 3 fits in the opening of the applicator head, so that the applicator-surface section 31 of the module 3 finishes off the applicator-surface area of the head 2 without creating any projecting or recessed discontinuities. Consequently, assembling the module 3 and the head 2 together makes it possible to create an applicator surface S having a single opening that, at this stage, is formed by the mouth of the housing 22. In FIGS. 1 and 2, it should be observed that the applicator-surface section 31 occupies the portion of the applicator surface S that slopes the most. The applicator head 2 also includes a peripheral skirt 23 that fits in the top end 12 of the hollow body 1. In addition, the wave-generator module 3 extends inside the reception space 1*c*, and advantageously presents a snap-fastener profile 34 that is suitable for co-operating with the bottom edge 14 of the separator partition 13. In this way, the applicator unit A may be mounted in completely stable manner on and in the hollow body 1.

The wave-generator module 3 makes it possible to generate any type of electromagnetic, vibratory, etc. wave or radiation, e.g. visible, infrared, or ultraviolet light, or microwaves, etc., or even ultrasound, or mechanical vibration. The module 3 may also generate heat or cold (thermal waves) so as to impart a hot or cold effect on contact with the skin.

Figure 7:
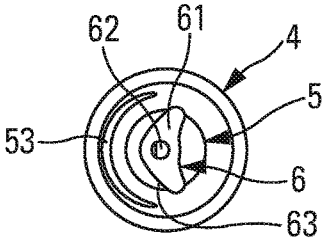
FIG. 7 is a plan view of the FIG. 6 dispenser.
Figure 6:
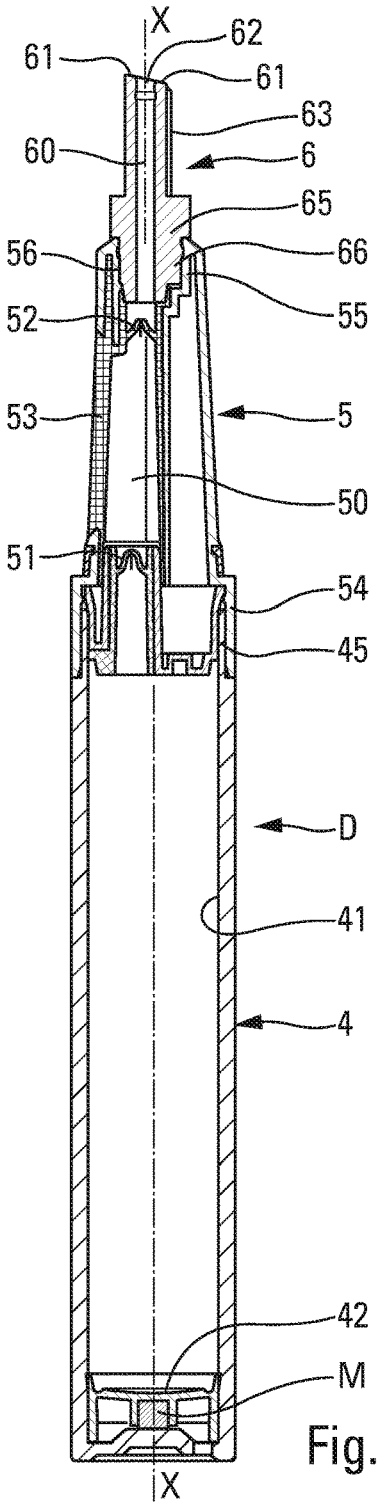
FIG. 6 is a vertical section view through a fluid dispenser of the invention.
Figure 8:
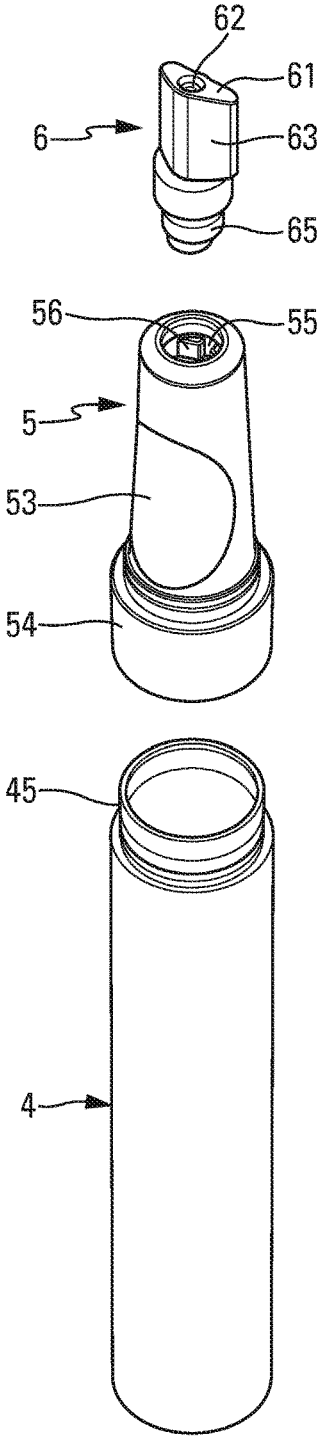
FIG. 8 is an exploded perspective view of the dispenser in FIGS. 6 and 7.

The dispenser unit or fluid dispenser D comprises a fluid reservoir 4, a pump 5, and a dispenser endpiece 6, as can be seen more clearly in FIGS. 6 to 8.

By way of example, the reservoir 4 may be in the form of a slide cylinder 41 in which there is received a follower piston 42 that is adapted to slide in the cylinder 41 as the fluid is extracted from the reservoir. The top of the cylinder 41 forms a neck 45. Instead of this particular reservoir, it is also possible to envisage a simpler reservoir in which the working volume does not vary, or a reservoir with a flexible pouch.

The pump 5 includes a fastener ring 54 that enables it to be mounted on the neck 45 of the reservoir 4. The pump 5 includes a pump chamber 50 that, at its bottom end, is provided with an inlet valve 51, e.g. in the form of a slotted shutter. At its top end, the pump chamber 50 includes an outlet valve 52 that may also be made in the form of a slotted shutter, for example. Furthermore, the pump chamber 50 includes a lateral actuator 53 that makes it possible to reduce the working volume of the pump chamber 50, and thus force the fluid through the outlet valve 52. The lateral actuator 53 is movable perpendicularly to the longitudinal axis X of the dispenser D. The movement may be in translation or by elastic deformation. In the embodiment used to illustrate the present invention, the actuator 53 is in the form of a flexible wall of the pump chamber 50 that is made by a method of bi-injection or of overmolding, for example. The pump 5 may thus be referred to as a flexible-diaphragm pump, in the sense that a movable wall of the chamber is actuated directly in order to put the fluid under pressure. At its top end, the pump 5 forms a mounting well 56 for mounting the dispenser endpiece 6. The mounting well 56 is advantageously provided with keying means 55, e.g. in the form of a projecting profile or a recess, making it possible to impose the angular orientation of the endpiece 6 in the well 56.

The dispenser endpiece 6 thus includes a mounting stub 65 that is engaged, and advantageously snap-fastened, inside the mounting well 56. The mounting stub 65 includes a keying profile that fits perfectly in the keying means 55 of the well 56, so as to impose the angular orientation of the dispenser endpiece 6 on the pump 5. In this way, the endpiece is always oriented in the same way relative to the lateral actuator 53 that extends on one side only of the pump 5. Above the mounting stub 65, the dispenser endpiece 6 forms an insertion appendage 63 having a cross-section that presents a shape that corresponds to the shape of the housing 22 formed by the applicator head 2. This shape can be seen more clearly in FIG. 7: it is similar to the shape of a crescent. The side wall of the insertion appendage 63 may be a non-circular cylinder over its entire height. In a variant, one or more projecting sealing beads may be provided, making it possible to establish sealing inside the housing 22. At its top end, the appendage 63 forms a substantially-plane outlet surface 61 that is perforated with a dispenser orifice 62, forming the outlet of an outlet duct 60 that passes through the appendage 63 and the mounting stub 65, as can be seen clearly in FIGS. 2 and 6.

Once the dispenser endpiece 6 is mounted on the pump 5, as visible in FIG. 6, it can be seen that the outlet valve 51 communicates directly with the outlet duct 60. Thus, by depressing the lateral actuator 53, the working volume of the pump chamber 50 is reduced, and fluid under pressure is forced through the outlet valve 52, from where it can flow through the outlet duct 60 until it reaches the dispenser orifice 62 situated at the outlet surface 61. When the pressure on the lateral actuator 53 is relaxed, the outlet valve 52 closes and the inlet valve 51 opens under the effect of the suction created in the pump chamber 50, thus enabling fluid to be sucked up from the reservoir 4, in which the follower piston 42 then moves towards the pump 5.

As can be understood from FIG. 4, the dispenser unit of the dispenser D is inserted inside the hollow body 1 through its bottom end 17, after removing the removable end wall 7. The dispenser D is thus inserted axially through the space 1*a*, then through the space 1*b* until the dispenser endpiece 6 penetrates into the housing 22 of the applicator head 2. As explained above, it is necessary to orientate the dispenser D angularly, so that its insertion appendage 63 is engaged inside the housing 22. The angular orientation is preferably a single angular orientation. It is thus possible to engage the appendage 63 fully inside the housing 22 until the outlet surface 61 comes level with the applicator surface S so as to finish it off. This can be seen in FIG. 2. It can be seen that the outlet surface 61 becomes completely flush with the applicator-surface area 21 of the head 2 so as to finish it off. Finally, only the dispenser orifice 62 breaks the continuity of the applicator surface S. In order to guarantee that the appendage 63 is engaged fully in the housing 22, use is made of the removable end wall 7 having flexible material 64 that comes into contact with the end wall of the reservoir 4 so as to push it upwards, and establish sealing at the housing 22. In this respect, it should also be observed that the bottom end of the reservoir 4 projects out from the hollow body 1 when the removable end wall 7 is removed, so as to make it easy to grip the dispenser by its reservoir 4 in order to remove it from the hollow body 1. As a result, the dispenser D is received in removable manner inside the hollow body 1 and the head 2. It should also be observed that the imposed angular orientation of the appendage 63 inside the housing 22 makes it possible to arrange the lateral actuator 53 facing the pusher 15 of the hollow body 1.

FIG. 3 shows the arrangement of the various component elements of the dispenser and applicator assembly of the invention, where it presents its egg shape. By way of example, it is possible to see that the generator module 3 is received inside the compartment 1*c* that is defined by the separator partition 13 that surrounds, in part, the pump 5, having its lateral actuator 53 covered by the lateral pusher 15. It can thus be said that the pump 5 is arranged between the module 3 and the pusher 15, inside the hollow body 1.

With such a design, the applicator unit A is received in removable manner on and in the reception unit R. In addition, the dispenser unit of the dispenser D is also received in removable manner inside the reception unit R and inside the housing 22 of the applicator unit A. In this way, the dispenser D and the applicator unit A may be replaced at will as a function of requirements. By way of example, it is possible to envisage that a particular dispenser dispensing a particular fluid is associated with a particular applicator unit. It thus suffices to mount the two units A and D in the reception unit R in order to constitute the dispenser and applicator assembly of the invention. When it is necessary to replace the units A and D, it is possible to remove each of them easily from the reception unit R.

It should also be observed that the fluid dispensed by the dispenser D leaves the dispenser only at the applicator surface S, such that no fluid can remain inside the reception unit R once the dispenser has been removed. Furthermore, as a result of the applicator surface S being completely smooth and continuous, it can easily be cleaned by rubbing or wiping. Thus, when a user wishes to change a dispenser, it suffices for the user to clean the applicator surface S beforehand, then to remove the dispenser and replace it with another. No soiling or fluid deposit can be observed.

In the embodiment used to illustrate the present invention, the wave-generator module 3 forms an applicator-surface sector 31. This is a particular non-limiting embodiment only, since it is entirely possible to envisage making the wave-generator module 3 without it forming a portion of the applicator surface S. By way of example, the module 3 may be associated with the applicator head 2 just below the applicator surface S, which applicator surface thus serves as diffuser means for diffusing the waves.

The complete independence between the dispenser D and the applicator unit A, except when assembled in the housing 22, makes it possible to disassociate the two units completely, such that they may be produced by entirely different suppliers, namely a supplier specialized in the design of dispensers, and a supplier specialized in the design of electronic wave-generator modules.

In the invention, the dispenser assembly is further provided with means for giving a visual and/or audible indication or information to the user of the assembly about the filling and emptying state of the reservoir 4. The information may be given on the dispenser assembly or it may be communicated remotely to a smartphone or a computer having a dedicated application or software installed thereon. In this particular assembly, the follower piston 42 is provided with a magnet M, preferably a permanent magnet, that is secured to the piston by interfitting, snap-fastening, force-fitting, overmolding, etc. In FIGS. 1, 2, and 6, it can be seen that the magnet M is arranged in a housing 43 formed by the piston 42. The magnet M is in the form of a pellet or of a small lug, e.g. of cylindrical shape, having a diameter of about 2 millimeters (mm) to 5 mm, and a height/thickness of about 2 mm to 4 mm. A volume in the range 10 $mm^3$ to 50 $mm^3$ can be envisaged, and preferably in preferred order 40 $mm^3$, 30 $mm^3$, or 20 $mm^3$. It would be advantageous for the attraction force of the magnet M to be small enough to ensure that the follower pistons 42 do not adhere to one another, so as to make them easier to manipulate in assembly lines.

The follower piston 42 is guided to move over a maximum stroke having a low initial position that is shown in FIGS. 1 and 6 and a high final position that is shown in FIG. 2. It can also be said that the piston 42 slides between a start position that corresponds to a substantially full state of the reservoir, and an end position that corresponds to a substantially empty state of the reservoir.

Still in the invention, the module 3 is provided with detector means comprising a magnetic-field sensor 35 that is capable of acting remotely to detect, in a small detection field, the magnetic field generated by the magnet M when it penetrates into the small detection field. The sensitivity of the sensor may be about 7 gauss (G), for example. The magnetic-field sensor 35 is arranged in the direct or immediate proximity of, or even in contact with, the outer wall of the slide cylinder 41 of the reservoir, so as to reduce the distance between the sensor 35 and the magnet M. The magnetic-field sensor 35 is axially positioned at the high final position of the follower piston 42, such that the magnet M penetrates into the small detection field when the follower piston 42 reaches an alert position that is close to the high final position. The alert position is preferably closer to the high final position than to the low initial position. Provision may also be made for there to be a plurality of alert positions, e.g. when the piston 42 is at mid-stroke, at three-fourths of its stroke, at 90% of its stroke, and/or at 100% of its stroke. An alert position at one-fourth of its stroke may also be envisaged.

The detector means also comprise alert means, coupled to the magnetic-field sensor 35, so as to deliver a visually or audibly perceptible alert signal. For the dispenser assembly in FIGS. 1 to 8, the alert means are in the form of a light source 36, e.g. of light emitting diode (LED) type, visible through a window 16 of the body 1. An audible warning may also be envisaged, replacing or complementing the light source 36.

In a practical aspect, the magnetic-field sensor 35 and the light source 36 may be mounted on a printed circuit card 37 of the module 3. It should be observed that the integrated circuit board extends substantially parallel to a plane that contains the fluid reservoir, the dispenser member, and the dispenser orifice.

Figure 9:
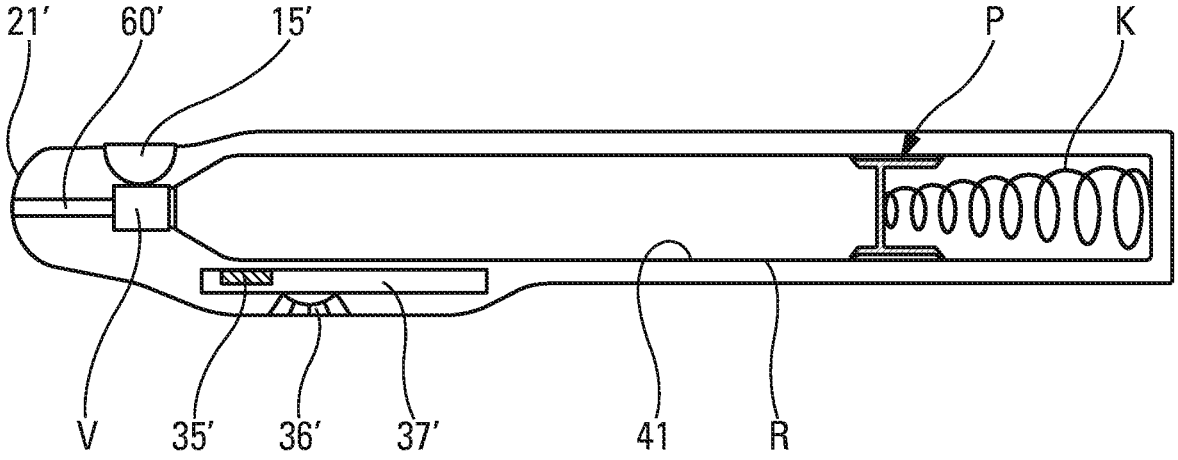
FIG. 9 is a diagrammatic section view through a fluid dispenser and applicator assembly constituting a second embodiment of the invention.
Figure 10:
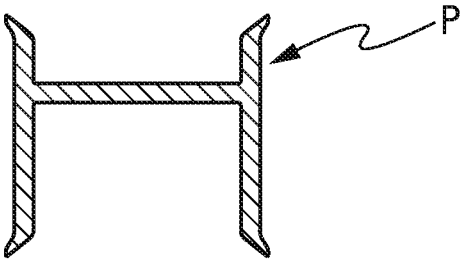
FIG. 10 is a larger-scale view of the FIG. 9 piston.

Reference is made below to FIGS. 9 and 10 in order to describe a second embodiment of the invention. The FIG. 9 dispenser and applicator assembly is shown only in very diagrammatic manner, but it is possible to identify a fluid reservoir R forming a slide cylinder 41 inside which there is mounted a piston P that is driven by a spring K. Thus, the fluid stored inside the reservoir R is subjected to pressure exerted by the piston P that is driven by the spring K. At its opposite end, the reservoir R is connected to a dispenser valve V that is actuatable by means of a pusher 15'. Thus, the user may press on the pusher 15' so as to open the dispenser valve V, so that the fluid stored under pressure in the reservoir R is forced through the open valve then through an outlet duct 60', so as to reach an applicator surface 21'. In this dispenser assembly, the reservoir R may also be in the form of a cartridge that is insertable into the dispenser assembly in such a manner as to become connected to the dispenser valve V. In a variant, the dispenser valve V may form an integral part of the cartridge.

In the invention, the dispenser assembly is also fitted with a printed circuit card 37' on which there is mounted a wavelength sensor 35' that, by way of example, may detect the wavelength corresponding to red. In addition, in the invention, some or all of the piston P may be made out of a plastics material that is red or that is coated with a red coating. Thus, when the piston P comes into the small detection field of the sensor 35', advantageously situated in the proximity of its final position, the sensor 35' sends an alert signal to an audible warning system 36' that is possibly mounted on the printed circuit card 37'.

Compared to the first dispenser assembly in FIGS. 1 to 8, the second dispenser assembly differs in that the piston P is not a follower piston but a pusher piston that is driven by a force, e.g. by a spring, the sensor is a wavelength sensor and not a magnetic-field sensor, and the alert is audible and no longer visual.

The piston P is also shown in larger-scale manner in FIG. 10. By way of example, it is possible to envisage that the outer periphery of the piston P is coated with a layer that is colored, e.g. red, that is detectable by the sensor 35'.

The sensor 35' is arranged at the end of stroke of the piston, but it could also be positioned at another location. It is also possible to envisage using a plurality of sensors 35' at various alert positions of the piston P, so as to provide various respective and distinct alert signals. By way of example, it is possible to provide a short tone when the piston arrives at mid-stroke, two short tones when it arrives at three-fourths of the stroke, and a single long tone when it arrives at the end of its stroke.

Figure 11:
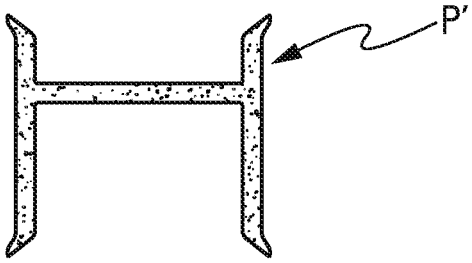
FIGS. 11 and 12 are views, similar to the view in FIG. 10, of two other variant embodiments of a piston of the invention.

FIG. 11 shows a variant embodiment for a piston P' that may be a follower piston or a pusher piston. Its distinctive feature resides in the fact that the piston P' is made out of a plastics material filled with magnetic particles. Such a piston P' may very well be used in the first embodiment in FIGS. 1 to 8, replacing the piston 42.

Figure 12:
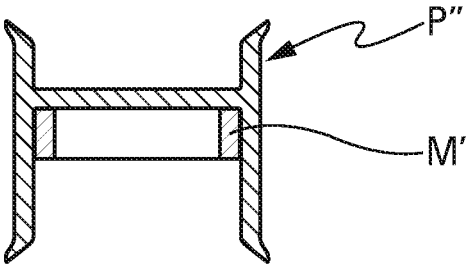

FIG. 12 shows yet another embodiment for a piston P" that includes a magnet M' that is in the form of an annulus or of a ring. The annular magnet M' may merely be force-fitted inside the piston. The advantage of an annular magnet M' resides in the fact that the magnet is closer to the cylinder 41 of the reservoir, and thus closer to the magnetic-field sensor 35. As a result, a weaker magnet may be used.

Clearly, a wavelength sensor 35' may also be used in the first embodiment in FIGS. 1 to 8, with the piston P. Conversely, a magnetic-field sensor may be used in place of the sensor 35' in the embodiment in FIG. 9. A piston such as the piston 42, the piston P', or the piston P" may thus be used in the second embodiment.

The embodiments described above use remote-detection technologies that use a magnetic field or color. However, other remote-detection technologies may be used, e.g. induction (detecting a magnetic field or detecting disruption of a magnetic field), optical (color, reflection, refraction, diffraction), the capacitive effect, ultrasound, the Hall effect, the Faraday effect, resistance variation, etc. By way of example, it is possible to provide detector means in the form of a magnetic-field-disruption sensor that emits a magnetic field, and a piston that includes an element that is capable of disrupting the magnetic field generated by the magnetic-field-disruption sensor. It is also possible to envisage an optical sensor that is sensitive to light reflection produced by reflective particles or by a coating carried by the piston.

The invention thus provides a dispenser assembly including a reservoir in which a piston (a follower piston or a pusher piston) moves, and having a filling and emptying state that can be communicated to the user by means of remote-detection means.

The invention claimed is:

1. A fluid dispenser assembly comprising a fluid reservoir (R), a dispenser member (5; V), and a dispenser orifice (62), the fluid reservoir (R) including a piston (42; P; P; P") that is movable in leaktight sliding contact in a slide cylinder (41) over a maximum stroke defined between a start position that corresponds to a substantially full state of the reservoir, and an end position that corresponds to a substantially empty state of the reservoir, the dispenser assembly further comprises a detector (35; 35') for detecting a physical property, the detector having a detection field that is small relative to the maximum stroke of the piston, the physical-property detector (35; 35') being arranged outside the fluid reservoir (R) so as to act remotely, through the slide cylinder (41), to detect a determined physical property that enters into the small detection field that covers an alert position of the piston that is closer to the end position than to the start position, the piston (42; P; P'; P") carrying said detectable determined physical property, the detector (35; 35') delivering, in response to a detection of the physical property, at least one alert signal that is perceptible to a user; and wherein the fluid reservoir (R), the dispenser member (5; V), and the dispenser orifice are formed by a dispenser (D) that is removably insertable into a casing (B) forming an applicator surface (S) and integrating the detector, which detector is mounted on an integrated circuit board that extends substantially parallel to a plane that contains the fluid reservoir (R), the dispenser member (5; V) and the dispenser orifice.

2. A dispenser assembly according to claim 1, wherein the slide cylinder is arranged between the piston (42; P; P; P") and the detector (35; 35'), the slide cylinder not preventing the detector (35; 35') from detecting the determined physical property.

3. A dispenser assembly according to claim 1, wherein the alert position is reached when the piston (42; P; P'; P") has moved through more than 75% of the maximum stroke of the piston from the start position.

4. The dispenser assembly according to claim 1, wherein the detector comprises a plurality of sensors and wherein the piston (42; P; P'; P") reaches a plurality of successive alert positions corresponding to the plurality of sensors as the piston moves towards the end position, the alert positions being successively detected by the corresponding sensors causing the detector (35; 35') to deliver a plurality of distinct respective alert signals.

5. A dispenser assembly according to claim 1, wherein the detector (35; 35') is positioned in contact with the slide cylinder, or in immediate proximity of the slide cylinder, so as to reduce the distance between them and the piston (42; P; P'; P").

6. A dispenser assembly according to claim 1, wherein the detector (35; 35') comprise a magnetic-field sensor, and the piston (42; P; P") is provided with a magnet (M; M') that generates a magnetic field as the detectable determined physical property.

7. A dispenser assembly according to claim 6, wherein the magnet (M) presents a volume that is less than 40 $mm^3$.

8. A dispenser assembly according to claim 6, wherein the magnet (M') is annular with an outside diameter that is a little smaller than the maximum outside diameter of the piston (42; P'; P"), such that the magnet (M') is close to the slide cylinder.

9. A dispenser assembly according to claim 1, wherein the detector comprise a magnetic-field sensor (35), and the piston (P') is made by injection-molding plastics material filled with magnetized particles.

10. A dispenser assembly according to claim 1, wherein the detector comprise a determined-wavelength sensor (35'), and the piston (P) absorbs waves having said determined wavelength, the determined wavelength is in the red, and the piston (P) is red at least in part.

11. A dispenser assembly, wherein according to claim 1, the detector comprise a magnetic-field-disruption sensor that emits a magnetic field, and the piston includes an element that is capable of disrupting the magnetic field generated by the magnetic-field-disruption sensor.

12. A dispenser assembly according to claim 1, wherein the piston (42; P; P; P") is a follower piston that moves when the fluid in the reservoir (R) is under suction.

13. The dispenser assembly according to claim 1, wherein the alert position is reached when the piston (42; P; P'; P") has moved through more than 90% of its the maximum stroke from the start position.

14. The dispenser assembly according to claim 1, wherein the alert position is reached when the piston (42; P; P'; P") has moved through 100% of its the maximum stroke of the piston from the start position.

15. The dispenser assembly according to claim 6, wherein the magnet (M) presents a volume that is less than 30 $mm^3$.

16. The dispenser assembly according to claim 6, wherein the magnet (M) presents a volume that is less than 20 $mm^3$.

* * * * *